US009387491B2

(12) United States Patent
Bodelson

(10) Patent No.: US 9,387,491 B2
(45) Date of Patent: Jul. 12, 2016

(54) CENTRIFUGAL SEPARATOR HAVING A VALVE BODY PROVIDED IN AN OUTLET CHANNEL

(71) Applicant: ALFA LAVAL CORPORATE AB, Lund (SE)

(72) Inventor: Berth Bodelson, Tullinge (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 14/772,672

(22) PCT Filed: Feb. 13, 2014

(86) PCT No.: PCT/EP2014/052803
§ 371 (c)(1),
(2) Date: Sep. 3, 2015

(87) PCT Pub. No.: WO2014/135350
PCT Pub. Date: Sep. 12, 2014

(65) Prior Publication Data

US 2016/0016182 A1 Jan. 21, 2016

(30) Foreign Application Priority Data

Mar. 6, 2013 (EP) ..... 13157942

(51) Int. Cl.
*B04B 1/18* (2006.01)
*B04B 11/04* (2006.01)
(Continued)

(52) U.S. Cl.
CPC . *B04B 11/04* (2013.01); *B04B 1/14* (2013.01); *B04B 1/18* (2013.01); *B04B 7/14* (2013.01)

(58) Field of Classification Search
CPC ..... B04B 1/10; B04B 1/12; B04B 1/14; B04B 1/16; B04B 1/18; B04B 7/14; B04B 11/04
See application file for complete search history.

(56) References Cited

U.S. PATENT DOCUMENTS 2,378,778 A * 6/1945 Lindgren ..... B04B 1/18 494/1
2,551,041 A * 5/1951 Nielsen ..... B04B 1/18 137/58

(Continued)

FOREIGN PATENT DOCUMENTS

DE 1182602 B * 11/1964 ..... B04B 1/18
DE 3832979 A1 * 4/1990 ..... B04B 1/14

(Continued)

OTHER PUBLICATIONS

Machine translation of DE 1182602.*

*Primary Examiner* — Charles Cooley
(74) *Attorney, Agent, or Firm* — Birch, Stewart, Kolasch & Birch, LLP

(57) ABSTRACT

A centrifugal separator includes a centrifuge rotor mounted to a spindle and includes a rotor casing enclosing a separation space. Peripheral ports extend from the separation space through the rotor casing. A valve slide is movable between a closed position closing the peripheral ports and an open position opening the peripheral ports. A closing chamber is provided between the valve slide and the rotor casing. An inlet channel supplies hydraulic medium to the closing chamber to hold the valve slide in the closed position. An outlet passage permits an outlet flow of the hydraulic medium for moving the valve slide to the open position. The outlet passage includes outlet channels extending though the rotor casing. A valve body is provided in each outlet channel and is axially movable from a closing position to an opening position against the direction of the outlet flow.

11 Claims, 4 Drawing Sheets

(51) Int. Cl.
*B04B 1/14* (2006.01)
*B04B 7/14* (2006.01)

(56) References Cited

U.S. PATENT DOCUMENTS 2,578,484 A * 12/1951 Nyrop ..... B04B 1/18 494/27
2,862,659 A * 12/1958 Nyrop ..... B04B 1/18 494/10
2,955,754 A * 10/1960 Nyrop ..... B04B 1/18 494/11
3,189,267 A * 6/1965 Thylefors ..... B04B 1/18 494/27
3,415,446 A * 12/1968 Weiland ..... B04B 1/14 494/2
3,550,843 A * 12/1970 Hoffmann ..... B04B 1/18 494/27
3,749,303 A * 7/1973 Hemfort ..... B04B 1/18 494/10
3,765,599 A * 10/1973 Hemfort ..... B04B 1/18 494/29
3,797,736 A * 3/1974 Gunnewig ..... B04B 11/04 494/2
3,871,575 A * 3/1975 Niemeyer ..... B04B 11/06 494/27
3,940,056 A * 2/1976 Schmidt ..... B04B 1/14 494/27
3,985,292 A * 10/1976 Schmidt ..... B04B 1/18 494/27
4,015,773 A * 4/1977 Thylefors ..... B04B 1/18 494/26
4,077,564 A * 3/1978 Thylefors ..... B04B 1/18 494/26
4,083,488 A * 4/1978 Gunnewig ..... B04B 1/14 494/27
4,151,951 A * 5/1979 Kohlstette ..... B04B 1/14 494/30
4,164,317 A * 8/1979 Nelson ..... B04B 1/14 494/27
4,193,537 A * 3/1980 Bodelson ..... B04B 1/14 494/27
4,243,172 A * 1/1981 Buffet ..... B04B 1/18 494/27
4,284,233 A * 8/1981 Kulker ..... B04B 1/14 494/27
4,285,462 A * 8/1981 Buffet ..... B04B 1/18 494/24
4,305,817 A * 12/1981 Kohlstette ..... B04B 1/14 210/104
4,354,632 A * 10/1982 Stroucken ..... B04B 1/14 494/27
4,375,870 A * 3/1983 Bodelson ..... F16K 3/26 251/235
4,410,319 A * 10/1983 Zettier ..... B04B 1/14 494/29
4,479,788 A * 10/1984 Kohlstette ..... B04B 1/18 494/27
4,490,133 A * 12/1984 Zettier ..... B04B 1/14 494/27
4,498,897 A * 2/1985 Gunnewig ..... B04B 1/18 494/27
4,505,700 A * 3/1985 Zettier ..... B04B 1/14 494/30
4,510,052 A * 4/1985 Eklof ..... B04B 1/14 210/139
4,514,183 A * 4/1985 Kohlstette ..... B04B 1/18 494/27
4,643,708 A * 2/1987 Stroucken ..... B04B 1/14 494/40
4,645,485 A * 2/1987 Niemerg ..... B04B 1/14 251/20
4,670,005 A * 6/1987 Kohlstette ..... B04B 1/14 494/27
4,717,376 A * 1/1988 Bruning ..... B04B 1/14 494/29
4,758,216 A * 7/1988 Wrede ..... B04B 1/14 494/40
4,781,670 A * 11/1988 Kohlstette ..... B04B 1/14 494/27
4,813,923 A * 3/1989 Johansson ..... B04B 1/10 494/40
4,925,442 A * 5/1990 Bodelson ..... B04B 1/14 494/27
5,618,409 A * 4/1997 Kreill ..... B04B 1/14 210/149
5,792,037 A * 8/1998 Bodelson ..... B04B 1/14 494/40
5,944,649 A * 8/1999 Karlsson ..... B04B 1/14 210/139
6,358,193 B1 * 3/2002 Nyberg ..... B03D 1/1418 494/10
2016/0016182 A1 * 1/2016 Bodelson ..... B04B 1/14

FOREIGN PATENT DOCUMENTS

DE 4026952 C1 * 9/1991 ..... B04B 1/18
EP 0706829 A1 * 4/1996 ..... B04B 1/14
EP 2774684 A1 * 9/2014 ..... B04B 1/14
FR 963524 A * 7/1950 ..... B04B 1/18
WO WO 8606300 A1 * 11/1986 ..... B04B 1/14
WO WO 2007045595 A1 * 4/2007 ..... B04B 1/14
WO WO 2010034751 A1 * 4/2010 ..... B04B 1/14
WO WO 2012029167 A1 * 3/2012 ..... B04B 1/08
WO WO 2013183857 A1 * 12/2013 ..... B04B 1/08

* cited by examiner

CENTRIFUGAL SEPARATOR HAVING A VALVE BODY PROVIDED IN AN OUTLET CHANNEL

THE TECHNICAL FIELD OF THE INVENTION

The present invention refers to a centrifugal separator and to the control of a valve slide for opening peripheral ports of a centrifuge rotor of a centrifugal separator. In particular, the present invention refers to a centrifugal separator. An example of a centrifugal separator is disclosed in U.S. Pat. No. 5,792,037.

In centrifugal separators of this kind, mixed solid and liquid particles forming a heavy phase, in the following sludge, are collected in an outer peripheral part of the separation space inside or immediately inside the peripheral ports. The peripheral ports are intermittently openable, during a short period of time in the order of milliseconds, to enable discharge of the sludge from the separation space to the surrounding space.

The centrifugal separator disclosed in U.S. Pat. No. 5,792,037 comprises a valve body associated with the outlet channel and pressed against a seat of the outlet channel against the direction of the outlet flow. In order to keep the closing chamber adjacent to the valve slide closed the valve body thus has to be pressed against the seat with a significant force. In case of an overpressure or underpressure in the centrifuge rotor and/or the closing chamber, the sealing of the valve body against the seat can be a problem. This solution can also be disadvantageous when the periphery speed of the centrifuge rotor increases and achieves a critical value. The development of centrifugal separators, especially with respect to the materials used, moves towards increasing periphery speeds which is advantageous with regard to the efficiency of the separation.

U.S. Pat. No. 4,514,183 discloses a centrifugal separator comprising a valve slide movable between a closed position, in which the peripheral ports are closed, and an open position, in which the peripheral ports are open. A closing chamber is provided between the valve slide and the rotor casing. An outlet passage is provided for discharging an outlet flow of the hydraulic medium from the closing chamber in order to move the valve slide to the open position. The outlet passage comprises a number of outlet channels for the outlet flow. Each outlet channel extends through the rotor casing and is associated with a respective sealing plate. The sealing plate is provided beneath the outlet channel and movable from the closing position to the opening position in the direction of the outlet flow.

U.S. Pat. No. 4,479,788 discloses a centrifugal separator comprising a valve slide movable between a closed position, in which the peripheral ports are closed, and an open position, in which the peripheral ports are open. A closing chamber is provided between the valve slide and the rotor casing. An outlet passage is provided for discharging an outlet flow of the hydraulic medium from the closing chamber in order to move the valve slide to the open position. The outlet passage comprises a number of outlet channels for the outlet flow. The outlet channels are associated with a common annular disk, which is axially displaceable and provided upstream the outlet channels in the closing chamber with respect to the outlet flow.

U.S. Pat. No. 4,670,005 discloses a centrifugal separator comprising a valve slide movable between a closed position, in which the peripheral ports are closed, and an open position, in which the peripheral ports are open. A closing chamber is provided between the valve slide and the rotor casing. An outlet passage is provided for discharging an outlet flow of the hydraulic medium from the closing chamber to a control chamber in order to move the valve slide to the open position. The outlet passage is formed by a valve gap and an annular valve body provided between the closing chamber and the control chamber. A number of bleed perforations extends outwardly to the surrounding space from the control chamber.

U.S. Pat. No. 2,862,659 discloses a further centrifugal separator comprising a centrifuge rotor with peripheral openings and an annular piston movable between a closed position, in which the peripheral openings are closed, and an open position, in which the peripheral ports are open. U.S. Pat. No. 2,862,659 illustrates one radially movable ejecting valve member for controlling the movement of the annular piston.

SUMMARY OF THE INVENTION

The object of the present invention is to overcome the problems discussed above and to provide a centrifugal separator having intermittently openable peripheral ports that are controllable independent of the pressure in the centrifuge rotor and the peripheral speed of the centrifuge rotor.

This object is achieved by a centrifugal separator described below.

By providing the valve body in the outlet channel instead of below the outlet channel as in the prior art disclosed in U.S. Pat. No. 5,792,037 and U.S. Pat. No. 4,514,813, it is possible to let the valve body be movable from the closing position to the opening position against the direction of the outlet flow. The sealing of the valve body against the valve seat will thus be independent of a possible overpressure in the centrifuge rotor or in the closing chamber beneath or adjacent to the valve slide. The sealing of the valve body is also secured independent of the peripheral speed of the centrifuge rotor. In addition, the sealing of the outlet channels is not dependent on a pressing force of a closing mechanism, which means that any number of outlet channels may be provided. Since the valve body is axially movable, the functioning thereof is ensured independently of the centrifugal forces.

According to an embodiment of the invention, the valve body rests against a valve seat in the outlet channel in the closing position.

According to a further embodiment of the invention, the centrifugal separator comprises a closing mechanism arranged to move the valve body from the closing position to the opening position by removing, or lifting, the valve body from the valve seat towards the valve slide.

According to a further embodiment of the invention, the closing mechanism comprises an annular control slide extending around the axis of rotation and being movable from a first position to a second position, thereby removing the valve body from the valve seat to the opening position. Consequently, also the closing movement of the annular control slide is opposite to the closing movement of the corresponding control components of the prior art, see especially U.S. Pat. No. 4,514,183.

According to a further embodiment of the invention, the closing mechanism also comprises an annular control chamber provided adjacent to or beneath the annular control slide, and a supply channel configured to supply a hydraulic medium to the annular control chamber in order to move the annular control slide to the second position, i.e. from the first position to the second position for removing or lifting the valve body from the valve seat.

According to a further embodiment of the invention, a restriction aperture extends from the annular control chamber to the surrounding space.

According to a further embodiment of the invention, the closing mechanism also comprises a number of pins, each being attached to and extending form the annular control slide to act on a respective one of the valve bodies. With such pins all the valve bodies may be simultaneously removed from the respective valve seat through the movement of the annular control slide along a direction parallel to the axis of rotation.

According to a further embodiment of the invention, each pin has a cross-sectional size that is smaller than the cross-sectional size of the valve body.

According to a further embodiment of the invention, the outlet passage comprises an annular outlet chamber located between the annular control slide and the outlet channels.

According to a further embodiment of the invention, the annular outlet chamber is outwardly open towards the surrounding space by means of an annular gap extending around the axis of rotation. Consequently, when the valve bodies are removed from their respective valve seats, the hydraulic medium contained in the closing chamber may instantly, or almost instantly, flow out through the outlet channels and the annular outlet chamber to the surrounding space so that the valve slide immediately will open the peripheral ports for discharge of the sludge. Since the hydraulic medium will be lost the valve slide will be open during a time period being sufficiently long to secure discharge of all sludge contained in the centrifuge rotor inside the peripheral ports.

According to another embodiment of the invention, the annular outlet chamber is closed by means of a wall extending from the annular control slide. In such a way a limited volume is created in the annular outlet chamber, determining the outlet flow of the hydraulic medium from the closing chamber. In such a way it is possible to control the length of the time period during which the peripheral ports are open. Consequently, according to this embodiment, partial discharge of sludge is possible, i.e. a part of the sludge will remain in the centrifuge rotor once the peripheral ports are closed again.

According to a further embodiment of the invention, at least one communication channel extends through the annular control slide and connects the annular control chamber and the annular outlet chamber to each other in order to enable transport of the hydraulic medium between the annular control chamber and the annular outlet chamber. By such a communication channel, the hydraulic medium may pass from the annular outlet chamber to the annular control chamber after the valve bodies have been moved to the opening position, thereby permitting the annular control slide to move from the second position to the first position.

According to a further embodiment of the invention, the annular control slide has a first projection area in a plane perpendicular to the axis of rotation in the annular outlet chamber and a second projection area in the plane perpendicular to the axis of rotation in the annular control chamber, wherein the second projection area is smaller than the first projection area. Such a configuration of the annular control slide permits the annular control slide to move from the second position to the first position when both the annular outlet chamber and the annular control chamber are filled with hydraulic medium.

According to a further embodiment of the invention, a further restriction aperture extends from the outlet chamber to the surrounding space.

BRIEF DESCRIPTION OF THE DRAWINGS

The present invention is now to explained more closely through a description of various embodiments and with reference to the drawings attached hereto.

DETAILED DESCRIPTION OF VARIOUS EMBODIMENTS OF THE INVENTION

Figure 1:
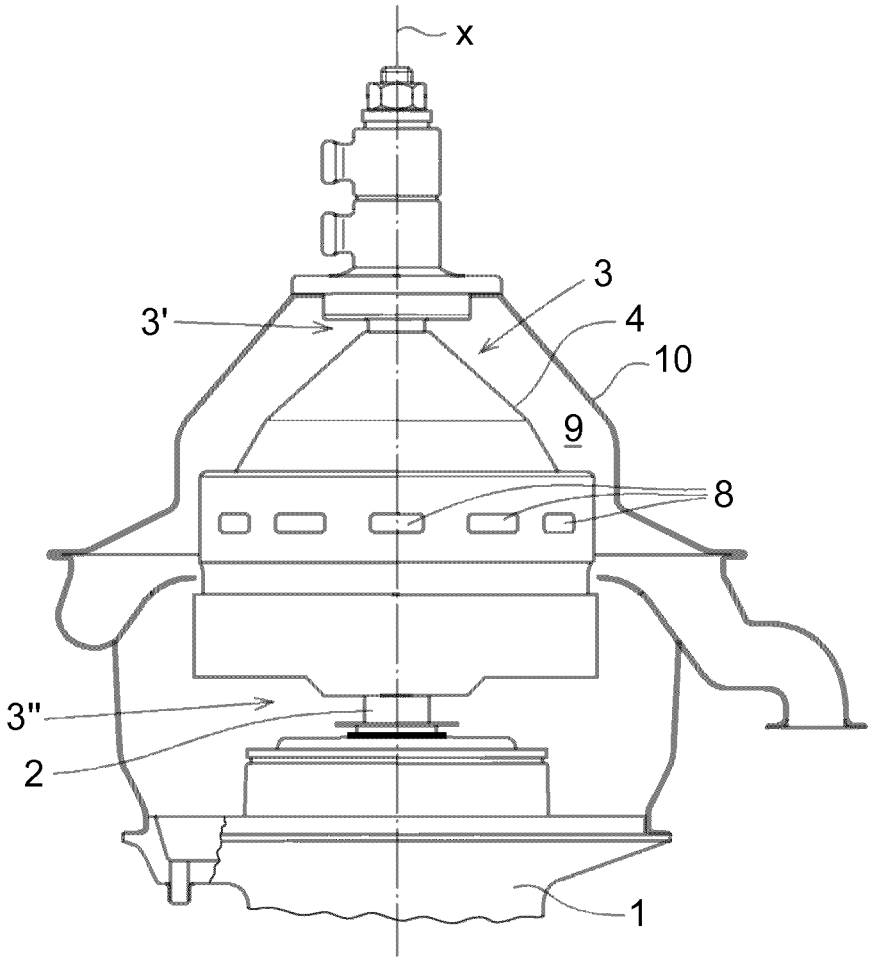
FIG. 1 discloses schematically a partly sectional view through a centrifugal separator.

FIG. 1 discloses a centrifugal separator comprising a frame 1, a spindle 2, which is rotably supported by the frame 1, and a centrifuge rotor 3. The centrifuge rotor 3 is mounted to the spindle 2 to rotate together with the spindle 2 around a axis x of rotation. The centrifuge rotor 3 comprises a rotor casing 4 enclosing a separation space 5, see FIGS. 2 and 3, in which a stack of separation disks 6 is arranged. The centrifuge rotor 3 has a first end 3' and a second end 3". The first end 3' normally forms an upper end and the second end 3" normally forms a lower end when the centrifugal separator is oriented so that the axis x of rotation extends vertically. In the embodiments disclosed, the rotor casing 4 comprises a first upper part 4' and a second, lower part 4".

A plurality of peripheral ports 8 extends from the separation space 5 through the rotor casing 4 to a surrounding space 9 outside the centrifuge rotor 3. In the embodiments disclosed, the surrounding space 9 is delimited by a stationary housing 10 which is attached to the frame 1. The peripheral ports 8 are intermittently openable during a short time period in the order of milliseconds, and permit total or partial discharge of sludge from the separation space 5, as will be explained below.

The centrifugal separator may be a so called hermetic separator having a centrifuge rotor 3 with a closed separation space 5, or an open separator having a centrifuge rotor 3 with a separation space 5 being open to the surrounding space 9 and thus to the surrounding pressure.

Figure 2:
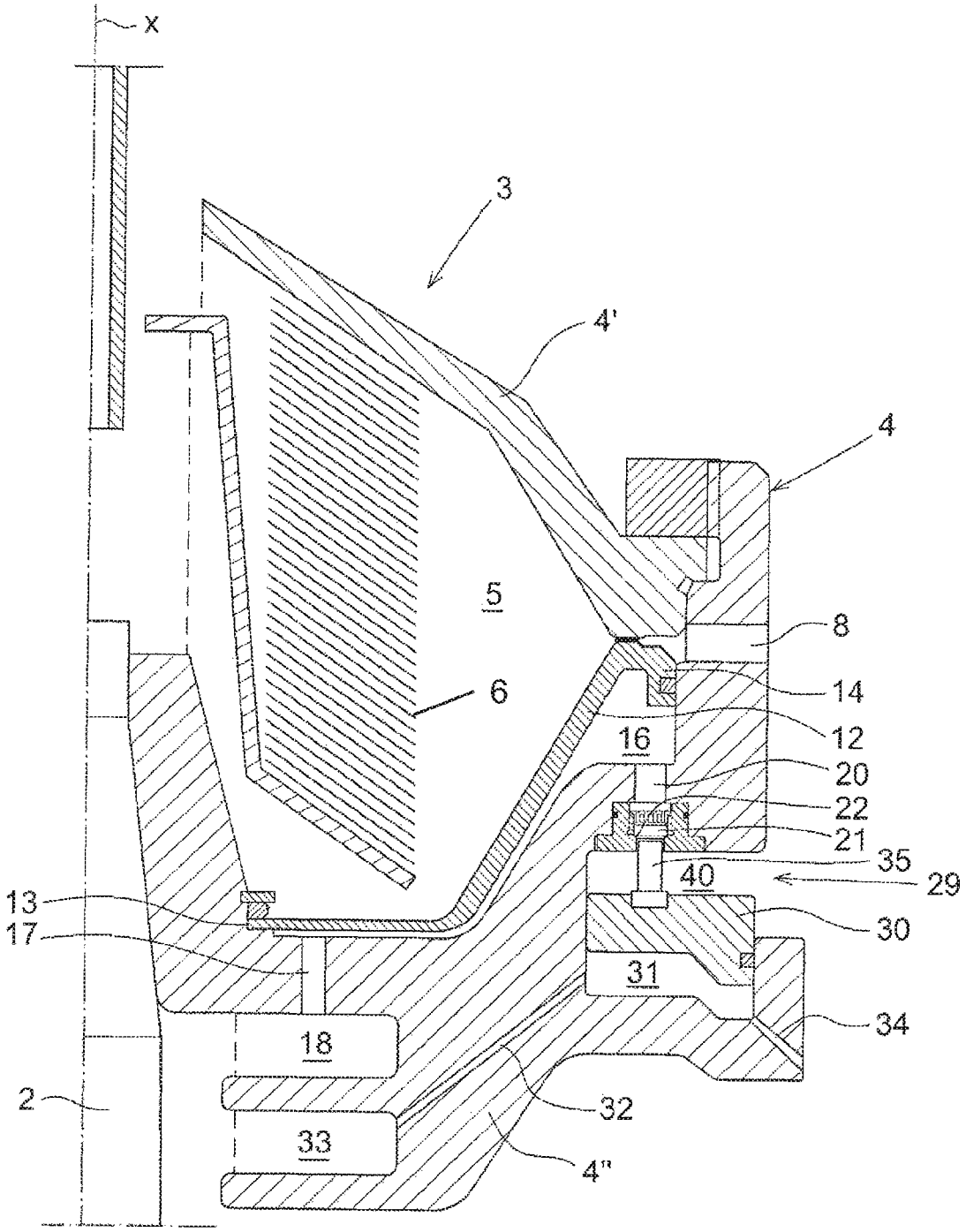
FIG. 2 discloses a sectional view of a part of a centrifuge rotor of a centrifugal separator according to a first embodiment of the invention.
Figure 3:
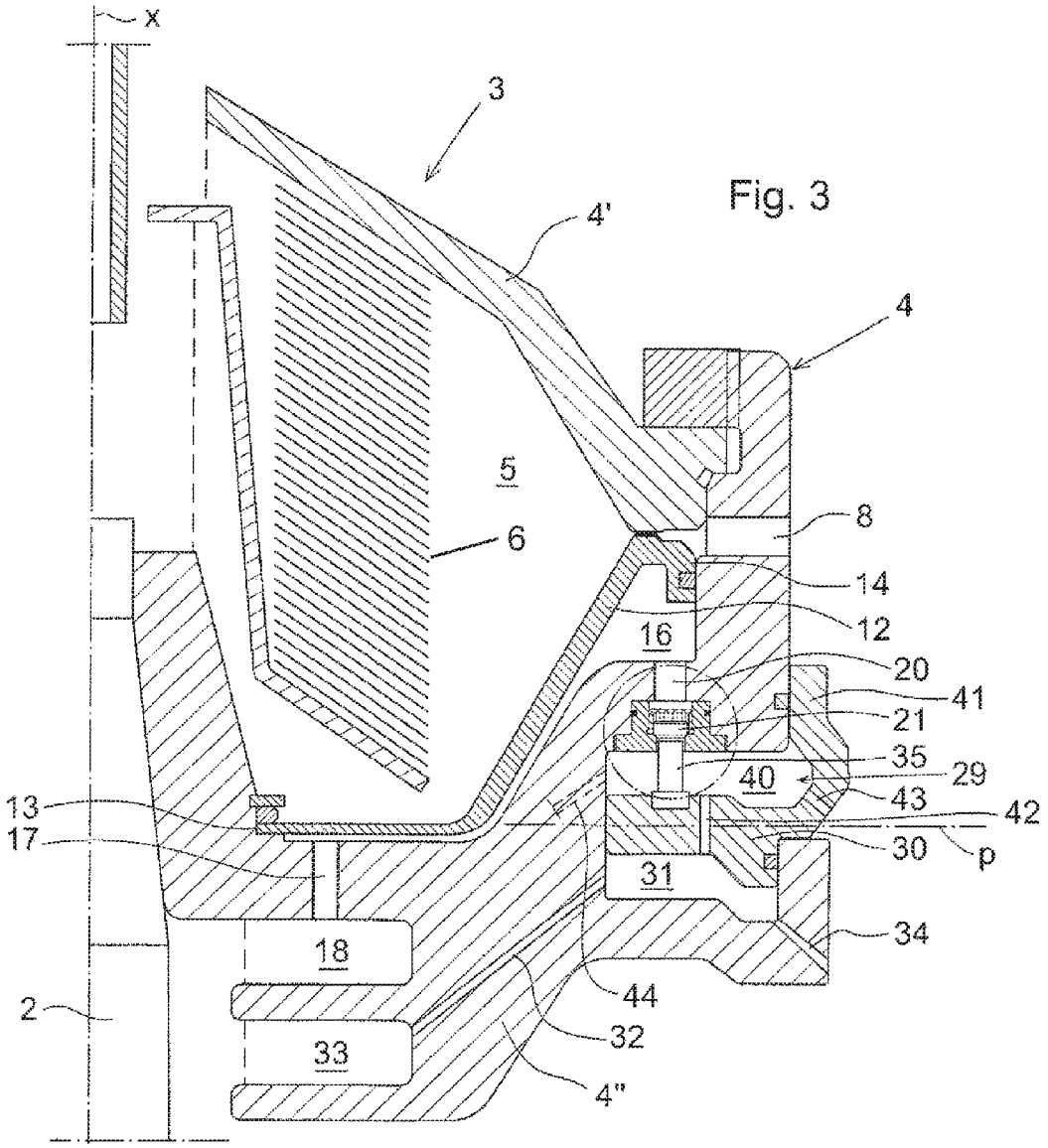
FIG. 3 discloses a sectional view of a part of a centrifuge rotor of a centrifugal separator according to a second embodiment of the invention.

The opening and closing of the peripheral ports 8 is controlled by means of a valve slide 12 which is movable between a closed position, shown in FIGS. 2 and 3, in which the peripheral ports 8 are closed, and a open position, in which the peripheral ports 8 are open. In the embodiments disclosed, the valve slide 12 is of a flexible kind, wherein an inner end 13 of the valve slide 12 is fixedly attached to the rotor casing 4 and the outer end 14 of the valve slide 12 is movable between the open and closed position along a direction parallel to the axis of rotation. Such a valve slide 12 is disclosed in U.S. Pat. No. 5,792,037. However, it is to be noted that the centrifuge rotor 3 of the centrifugal separator also may comprise a rigid valve slide 12 which is movable as a whole between the open position and the closed position along the direction parallel to the axis of rotation, whereby both the inner end and the outer end slide against corresponding sliding surfaces of the rotor casing 4. Such a valve slide is disclosed in U.S. Pat. No. 4,514,183.

A closing chamber 16 is provided between the valve slide 12 and the rotor casing 4. The closing chamber 16 contains a hydraulic medium (such as water), acting on the valve slide 12. An inlet channel 17 extends through the rotor casing 4 and is configured for supplying the hydraulic medium to the closing chamber 16 in order to hold the valve slide 12 in the closed position. The inlet channel 17 is connected to an annular closing groove 18 which thus communicates with the closing chamber 16 via the inlet channel 17. By introducing the hydraulic medium into the annular closing groove 18 upon start up of the centrifuge rotor 3, the hydraulic medium will be contained in the annular closing groove 18 and the closing chamber 16 by means of the centrifugal forces to keep the valve slide 12 in the closed position shown in FIG. 2.

An outlet passage for discharging an outlet flow of the hydraulic medium from the closing chamber 16 is provided in order to move the valve slide 12 to the open position, thereby permitting discharge of the sludge.

In the embodiments disclosed, the outlet passage comprises a number of outlet channels 20 for the outlet flow of the hydraulic medium. For instance the number of outlet channels 20 may be 2, 3, 4, 5, 6, or even more, preferably equidistantly distributed around the axis x of rotation. As mentioned above, any number of outlet channels 20 may be provided. Each outlet channel 20 extends through the rotor casing 4, in the embodiments disclosed through the lower part 4" of the rotor casing 4, and is associated with a respective valve body 21.

More specifically, the valve body 21 is provided in the outlet channel 20. The valve body 21 is axially movable from a closing position to an opening position against the direction of the outlet flow of the hydraulic medium from the closing chamber 16. Each valve body 21 is thus axially movable, i.e. movable in a direction parallel to the axis x of rotation towards the first end 3' of the centrifuge rotor 3.

Figure 4:
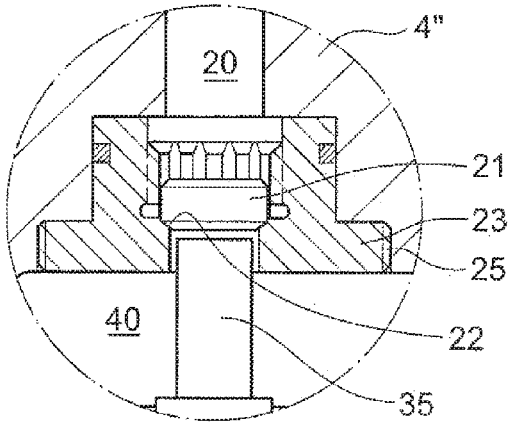
FIG. 4 disclose a sectional view of details of the centrifuge rotor of the first and second embodiment.

When the valve slide 12 is in the closed position disclosed, the valve body 21 rests against a valve seat 22 in the outlet channel 20, i.e. the valve body 21 is in the closing position, see FIG. 4.

In the embodiments disclosed, the valve body 21 has a cylindrical, especially circular cylindrical, shape. At the lower end, and possible also at the upper end, the edge, between the cylindrical surface and the end surface of the valve body 21, is chamfered. Such a chamfer at the lower end provides a sealing against the valve seat 22 having a corresponding surface. It is to be noted that the valve body 21 also may have other shapes, for instance a spherical shape.

In the embodiments disclosed in the figures, the valve body 21 has such dimensions, that it is prevented from passing through the outlet channel 20 into the closing chamber 16. However, this is not mandatory, since the pressure in the closing chamber 16 would prevent the valve bodies 21 from reaching the closing chamber 16.

The valve body 21 may be provided in an insert member 23 forming a portion, in the embodiments disclosed a lower portion, of the outlet channel 20.

Moreover, in the embodiments disclosed in the figures, the diameter of the outlet channel 20 in the insert member 23 is greater than the diameter of the outlet channel 20 above the insert member 23. Thus, the diameter of the valve body 21 is greater than the diameter of the outlet channel 20 above the insert member 23. However, the diameter of the outlet channel 20 may also be constant, or even increasing towards the closing chamber 16, above the valve seat 22.

Figure 6:
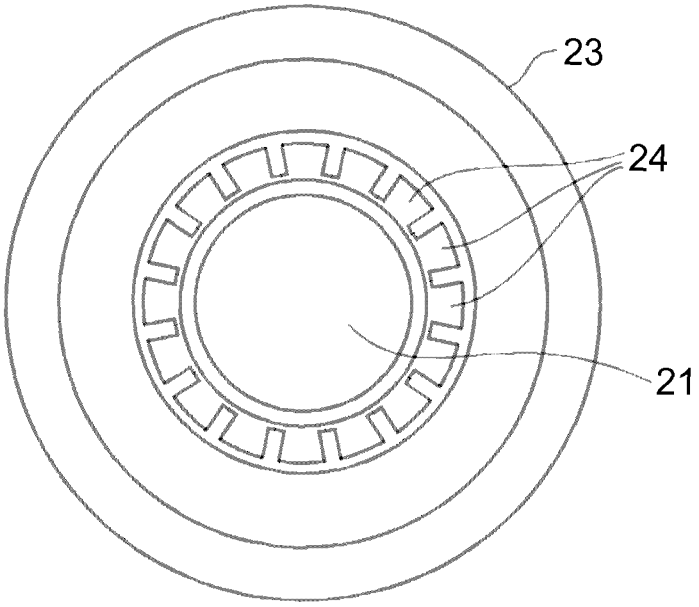
FIG. 6 discloses a view from above of a valve body of the centrifuge rotor.

The insert member 23, also comprises axially extending grooves 24 around the valve body 21, see especially FIG. 6. The grooves 24 are equidistantly distributed around the wall of the outlet channel 20 in the insert member 23. Consequently, when the valve body 21 is lifted from the valve seat 22, the hydraulic member from the closing chamber 16 may pass the valve body 21 in the grooves 24. The insert member 23 is mounted in the rotor casing 4, in the embodiments disclosed the lower part 4", by means of a screw thread 25.

The centrifugal separator also comprises a closing mechanism arranged to move the valve body 21 from the closing position to the opening position by removing or lifting the valve body 21 from the valve seat 22 towards the valve slide 12. The closing mechanism is provided in the lower part 4" of the rotor casing 4, and partly housed in an annular cavity 29 of the lower part 4".

The closing mechanism comprises an annular control slide 30 extending around the axis x of rotation. The annular control slide 30 is movable in the annular cavity 29 in an axial direction parallel to the axis x of rotation from a first position to a second position, thereby removing the valve body 21 from the closing position and the valve seat 22 to the opening position.

The closing mechanism also comprises an annular control chamber 31 which is provided in the annular cavity 29 adjacent to the annular control slide 30 and a supply channel 32 configured to supply hydraulic medium to the annular control chamber 31 in order to move the annular control slide 30. The supply channel 32 is connected to an annular opening groove 33 which thus communicates with the annular control chamber 31 via the supply channel 32. By introducing the hydraulic medium into the annular opening groove 33 during operation of the centrifuge rotor 3, the hydraulic medium will be fed to the annular control chamber 31 thereby moving the annular control slide 30 in the axial direction towards the first end 3' of the centrifuge rotor 3. A restriction aperture 34 extends from the annular control chamber 31 to the surrounding space 9.

The closing mechanism also comprises a number of pins 35, corresponding to the number of outlet channels 20 and valve bodies 21. The pins 35 extends from, and are attached to the annular control slide 30 to act on a respective one of the valve bodies 21 when the annular control slide 30 is moved towards the first end 3' of the centrifuge rotor 3. Consequently, each pin 35 will act on a respective valve body 21 for removing or lifting the valve body 21 from the valve seat 22.

Figure 5:
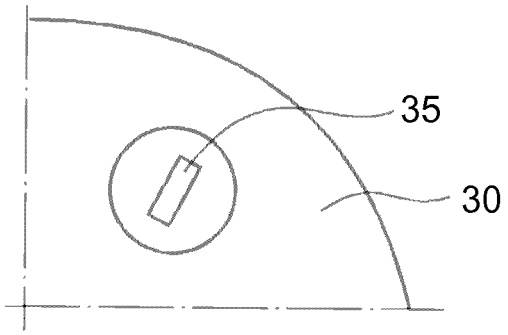
FIG. 5 discloses a view from above of a part of annular control slide of the centrifuge rotor.

Each pin 35 has a cross-sectional size that is smaller than the cross-sectional size of the valve body 21. In the embodiments disclosed, each pin 35 has a rectangular cross-section, see FIG. 5. It is to be noted that the pins 35 may have other cross-sectional shapes than those shown, for instance a circular, an oval, a square, etc. cross-sectional shape.

The outlet passage also comprises an annular outlet chamber 40 which is located in the annular cavity 29 between the annular control slide 30 and the outlet channels 20.

In the first embodiment disclosed in FIG. 2, the annular outlet chamber 40 is outwardly open towards the surrounding space 9 by means of an annular gap extending around the axis x of rotation. When the valve bodies 21 are in the opening position, i.e. lifted from the respective valve seats 22, the hydraulic medium contained in the closing chamber 16 will thus instantly flow out through the outlet channels 20 and the annular outlet chamber 40 to the surrounding space 9 via the annular gap. Since there are no restrictions in the annular outlet chamber 40, the closing chamber 16 will be almost instantly discharged so that the valve slide 12 will open quickly and remain open during a time period sufficient to permit discharge of all sludge in the separation space 5. For such a total discharge of sludge, the time period may be in the order of tens of milliseconds, such as 30-80 milliseconds, for instance about 50 milliseconds, depending on the size of the centrifugal separator. After the discharge of sludge, the annular control slide 30 will be moved back from the second position to the first position, wherein the hydraulic medium in the annular control chamber 31 is discharged via the restriction aperture 34.

The second embodiment, disclosed in FIG. 3, differs from the first embodiment in that the annular outlet chamber 40 is closed by means of a wall 41 extending from the annular control slide 30. In the second embodiment, the wall 41 is an integrated part of the annular control slide 30, but could as an alternative be a separate part mounted to the annular control slide 30. It should be noted that the same or corresponding elements have been denoted with the same reference signs in all embodiments disclosed in the application.

The second embodiment enables partial discharge of sludge, i.e. discharge of a part of the sludge in the separation space 5. Such a partial discharge requires a shorter time period during which the peripheral ports 8 are open than for total discharge. The time period is dependent on the size of the centrifugal separator. For a medium-sized centrifugal separator the time period for a partial discharge may typically be in the order of 2 to 30 ms. The limitation of the discharge to a part of the sludge, is achieved thanks to the limited volume of the annular outlet chamber 40.

The time period is dependent on the size of the centrifugal separator. For a medium-sized centrifugal separator the time period for a partial discharge may typically be in the order of 2 to 30 ms. The limitation of the discharge to a part of the sludge, is achieved thanks to the limited volume of the annular outlet chamber 41.

At least one communication channel 42 extends through the annular control slide 30. The communication channel 42 connects the annular control chamber 31 and the annular outlet chamber 40 to each other to permit transport of hydraulic medium between the annular control chamber 31 and the annular outlet chamber 40. The annular control slide 30 has a first projection area in a plane p perpendicular to the axis x of rotation in the annular outlet chamber 40, and a second projection area in the plane p in the annular control chamber 31. The second area is smaller than the first projection area.

A further restriction aperture 43 is provided and extends from the annular outlet chamber 40 to the surrounding space 9. In the second embodiment disclosed, the restriction aperture 43 extends through the wall 41.

By such a communication channel 42, the hydraulic medium may pass from the annular outlet chamber 40 to annular control chamber 31 after the valve bodies 21 have been moved to the opening position, thereby permitting the annular control slide 30 to move from the second position to the first position. Thanks to the fact that the second projection area is smaller than the first projection area, a force will be created acting on the annular control slide 30 to move the annular control slide 30 from the second position back to the first position when both the annular outlet chamber and the annular control chamber 31 are filled with hydraulic medium.

When the annular control slide 30 has been moved back to the first position, the hydraulic medium in the annular control chamber 31 and the annular outlet chamber 40 is discharged via the restriction aperture 34 and the further restriction aperture 43, respectively.

It is to be noted that in the second embodiment, the annular outlet chamber 40 may be pre-filled to a certain extent via a further channel 44 to the annular outlet chamber 40. In such a way, it is possible to control or vary the length of the time period during which the peripheral ports 8 are open.

The present invention is not limited to the embodiments disclosed, but may be varied and modified within the scope of the following claims.

The invention claimed is:

1. A centrifugal separator comprising:

a frame;

a spindle rotably supported by the frame;

a centrifuge rotor mounted to the spindle to rotate together with the spindle around an axis of rotation, wherein the centrifuge rotor comprises a rotor casing enclosing a separation space in which a stack of separation disks is arranged;

a plurality of peripheral ports extending from the separation space through the rotor casing to a surrounding space;

a valve slide movable between a closed position, in which the peripheral ports are closed, and an open position, in which the peripheral ports are open;

a closing chamber provided between the valve slide and the rotor casing and containing a hydraulic medium acting on the valve slide;

an inlet channel configured for supplying the hydraulic medium to the closing chamber in order to hold the valve slide in the closed position; and an outlet passage for discharging an outlet flow of the hydraulic medium in an outlet direction from the closing chamber in order to move the valve slide to the open position, wherein the outlet passage comprises a number of outlet channels for the outlet flow, and wherein each outlet channel extends through the rotor casing and is associated with a respective valve body, wherein the valve body is provided in the outlet channel and is axially movable in a direction parallel to the axis of rotation from a closing position to an opening position against the outlet direction in order to permit the outlet flow, wherein the valve body rests against a valve seat in the outlet channel when the valve body is in the closing position, wherein the centrifugal separator comprises a closing mechanism arranged to move the valve body from the closing position to the opening position by removing the valve body from the valve seat towards the valve slide, wherein the closing mechanism comprises an annular control slide extending around the axis of rotation and being movable from a first position to a second position, thereby removing the valve body from the valve seat to the opening position.

2. The centrifugal separator according to claim 1, wherein the closing mechanism comprises an annular control chamber provided adjacent to the annular control slide and a supply channel configured to supply hydraulic medium to the annular control chamber in order to move the annular control slide to the second position.

3. The centrifugal separator according to claim 2, wherein a restriction aperture extends from the annular control chamber to the surrounding space.

4. The centrifugal separator according to claim 2, wherein the outlet passage comprises an annular outlet chamber located between the annular control slide and the outlet channels, and wherein at least one communication channel extends through the annular control slide and connects the annular control chamber and the annular outlet chamber to each other in order to enable transport of hydraulic medium between the annular control chamber and the annular outlet chamber.

5. The centrifugal separator according to claim 4, wherein the annular control slide has a first projection area in a plane perpendicular to the axis of rotation in the annular outlet chamber and a second projection area in the plane perpendicular to the axis of rotation in the annular control chamber, and wherein the second projection area is smaller than the first projection area.

6. The centrifugal separator according to claim 4, wherein a second restriction aperture extends from the annular outlet chamber to the surrounding space.

7. The centrifugal separator according to claim 1, wherein the closing mechanism comprises a number of pins, each of the number of pins extending from the annular control slide to act on a respective one of the valve bodies.

8. The centrifugal separator according to claim 7, wherein each of the number of pins has a cross-sectional size that is smaller than the cross-sectional size of the valve body.

9. The centrifugal separator according to claim 1, wherein the outlet passage comprises an annular outlet chamber located between the annular control slide and the outlet channels.

10. The centrifugal separator according to claim 9, wherein the annular outlet chamber is outwardly open towards the surrounding space by an annular gap extending around the axis of rotation.

11. The centrifugal separator according to claim 9, wherein the annular outlet chamber is closed by a wall extending from the annular control slide.

* * * * *